US006706800B2

(12) United States Patent
Tanno et al.

(10) Patent No.: US 6,706,800 B2
(45) Date of Patent: Mar. 16, 2004

(54) AQUEOUS EMULSION COMPOSITION, METHOD OF BACKING CARPET, AND CARPET

(75) Inventors: Teturo Tanno, Tokyo (JP); Kenzi Seimiya, Tokyo (JP)

(73) Assignee: Emulsion Technology Co., LTD, Tokyo (JP)

( * ) Notice: Subject to any disclaimer, the term of this patent is extended or adjusted under 35 U.S.C. 154(b) by 0 days.

(21) Appl. No.: 09/764,107

(22) Filed: Jan. 19, 2001

(65) Prior Publication Data

US 2002/0066529 A1 Jun. 6, 2002

(30) Foreign Application Priority Data

Oct. 17, 2000 (JP) ..... 2000-316251

(51) Int. Cl.[7] ..... C08K 3/00
(52) U.S. Cl. ..... 524/500
(58) Field of Search ..... 524/500

(56) References Cited

U.S. PATENT DOCUMENTS 5,159,011 A * 10/1992 Rau ..... 524/562
5,514,435 A * 5/1996 Suzuki ..... 428/40
6,309,707 B1 * 10/2001 Mayer ..... 427/386

FOREIGN PATENT DOCUMENTS

JP 06-154070 6/1994

* cited by examiner

*Primary Examiner*—Edward J. Cain
(74) *Attorney, Agent, or Firm*—Oblon, Spivak, McClelland, Maier & Neustadt, P.C.

(57) ABSTRACT

A method of backing a carpet, comprising the steps of applying, to the back of a carpet, an aqueous emulsion composition prepared by adding a polyisocyanate compound to a specific high-solid-content emulsion compound, laminating a fabric to the composition-applied surface of the carpet, and thermally curing and then drying the emulsion composition applied; and a carpet backed by this method. The aqueous emulsion composition for use in this method is highly safe and easy to handle. Moreover, even when this emulsion composition is applied to the back of a carpet to a thickness of as great as 1 mm or more, it is cured and dried in a short time. The shortcomings in the conventional methods using aqueous emulsions can thus be successfully overcome by this method.

25 Claims, No Drawings

AQUEOUS EMULSION COMPOSITION, METHOD OF BACKING CARPET, AND CARPET

FIELD OF THE INVENTION

The present invention relates to a method of backing carpets, and to carpets backed by the method. More particularly, the present invention relates to a method of backing carpets to be laid chiefly on indoor floorboards or various floor coverings, and to carpets backed by the method.

BACKGROUND OF THE INVENTION

Heretofore, the backing of carpets has been conducted in the following manner: after treating the back of carpets, for example, by a method in which sols prepared by mixing vinyl chloride resins and plasticizers are applied, and cured by heating, a method in which latex compounds are applied, and dried by heating, a method in which mixtures of aqueous emulsions and thermoplastic resin powders are applied, and dried by heating, a method in which thermoplastic resin powders are sprinkled, and melted by heating, a method in which melted thermoplastic resins extruded from extruders are applied, or a method in which thermoplastic resin sheets are laid, and melted by heating, fabrics such as non-woven fabrics are laminated to the treated surfaces of the carpets.

However, the above-described conventional methods for treating carpets to be backed have the following drawbacks. Vinyl chloride resins, which are usually used for backing tile carpets (square carpets), emit dioxin and chlorine gas when carpets backed by using these resins are incinerated as wastes after use. In addition, plasticizers for use with vinyl chloride resins include DOP, DBP, etc., which can pollute the environment. Further, in the case where thick fabrics such as non-woven fabrics are laminated to the back of carpets after applying thereto latices or aqueous emulsions, the resulting laminates show poor air permeability, so that the latices or aqueous emulsions applied cannot be dried in a short time. This makes the production rate lower, and the productivity is thus decreased. In the case of hot melt coating, there is a limitation on the width of carpets to be treated; this is one cause of increase in production cost. Moreover, powders tend to scatter during operation, so that the use of powders is unfavorable from the viewpoint of working environment.

An object of the present invention is to provide a practical method of backing a carpet, using a polymeric emulsion compound that is safe and easy to handle, capable of overcoming the drawbacks with the conventional methods using aqueous systems, that is, capable of attaining rapid drying and curing of the emulsion compound even when the emulsion compound is applied to a thickness of as great as 1 mm or more. Another object of the present invention is to provide a carpet backed by this method.

SUMMARY OF THE INVENTION

The present invention provides a method of backing a carpet, comprising the steps of applying an aqueous emulsion composition described below to the back of a carpet, laminating a fabric to the composition-applied surface of the carpet, and thermally curing and then drying the composition applied; and a carpet backed by this method.

Aqueous Emulsion Composition

An aqueous emulsion composition for use in the present invention comprises:

a high-solid-content emulsion compound comprising:

(A) 100 parts by weight (solid basis) of at least one latex or emulsion selected from the group consisting of styrene-butadiene copolymer latices, acrylic resin emulsions, ethylene-vinyl acetate copolymer emulsions, acrylonitrile-butadiene copolymer latices, urethane resin emulsions, and natural rubber latices, (B) 0.3 to 2 parts by weight of a dispersing agent, (C) 0.5 to 5 parts by weight of a crosslinking agent, (D) 0.1 to 4 parts by weight of an anti-foaming agent, and (E) 100 to 600 parts by weight of at least one powdered filler selected from the group consisting of calcium carbonate, aluminum hydroxide, silica sand, and barium sulfate; and (F) 0.5 to 30 parts by weight of a polyisocyanate compound having reactive isocyanate group, wherein the polyisocyanate compound is added to the high-solid-content emulsion compound.

DESCRIPTION OF THE PREFERRED EMBODIMENTS

According to the present invention, the aqueous emulsion composition is obtained, preferably just before use, by adding the polyisocyanate compound, which serves as a curing agent, to the high-solid-content emulsion compound, and used for backing a carpet. The polyisocyanate compound reacts with water contained in the emulsion compound to cure the aqueous emulsion composition, so that the aqueous emulsion composition applied is dried quickly. Therefore, even when the aqueous emulsion composition is applied to the back of a carpet to a thickness of as great as 1 mm or more, high productivity can be attained regardless of the thickness of a fabric such as a non-woven fabric laminated to the back of the carpet. A backed carpet can thus be inexpensively obtained. Moreover, even when the aqueous emulsion composition is applied to the back of a carpet to a thickness of as great as 1 mm or more, the obtained carpet shows elasticity without using any plasticizer. In addition, when the obtained carpet is burned, it scarcely fumes and it emits only small amounts of toxic gasses. A backed carpet favorable from the viewpoint of environmental pollution can thus be successfully obtained by the method of the invention.

Aqueous Emulsion Composition

Component (A)

Component (A) for use in the aqueous emulsion composition of the present invention is at least one base rubber emulsion selected from the group consisting of styrene-butadiene copolymer latices, acrylic resin emulsions, ethylene-vinyl acetate copolymer emulsions, acrylonitrile-butadiene copolymer latices, urethane resin emulsions, and natural rubber latices.

Component (A) is used in the aqueous emulsion composition of the invention as a base rubber. This component serves as a binder and as an anchorage for carpet yarn, and imparts anti-folding properties and elasticity to a carpet.

Styrene-butadiene copolymer latices useful for component (A) are, for instance, SBR latices obtainable by copolymerization of 15 to 85% by weight, preferably 25 to 50% by weight of styrene with 85 to 15% by weight, preferably 75 to 50% by weight of butadiene, having glass transition temperatures of −60 to −10° C., preferably −50 to −15° C. The SBR latices may be carboxy-modifed ones obtained by copolymerizing the above two monomers and not more than 8% by weight, preferably about 0.5 to 5% by weight of, for example, acrylic, methacrylic, itaconic, phthalic or maleic acid. The SBR latices may also be amide-modified ones obtained by copolymerizing the above two monomers and (meth)acrylic amide or the like.

Acrylic resin emulsions that are used as component (A) are preferably acrylic ester-methacrylic acid-styrene copolymer emulsions having glass transition temperatures of −60 to −10° C., preferably −50 to −15° C., obtained by emulsion-copolymerizing acrylic esters, methacrylic acid, and styrene. Examples of acrylic esters useful herein include those ones having 1 to 4 carbon atoms, such as methyl acrylate, hydroxyethyl acrylate and butyl acrylate. The acrylic ester/methacrylic acid/styrene ratio for copolymerization is (40 to 90% by weight)/(60 to 10% by weight)/(10 to 60% by weight), preferably (50 to 80% by weight) (50 to 20% by weight) (10 to 30% by weight) The acrylic resin emulsions may be carboxy-modifed ones obtained by copolymerizing the above three monomers and not more than 8% by weight, preferably about 0. 5 to 5% by weight of, for example, acrylic, methacrylic, itaconic, phthalic or maleic acid. The acrylic resin emulsions may also be amide-modified ones obtained by copolymerizing the above three monomers and (meth)acrylic amide or the like.

Ethylene-vinyl acetate emulsions that can be used as component (A) are EVA emulsions obtainable by copolymerization of 10 to 40% by weight, preferably 15 to 30% by weight of ethylene with 90 to 60% by weight, preferably 85 to 70% by weight of vinyl acetate, having glass transition temperatures between −35° C. and +10° C., preferably between −30° and 0 C°.

Acrylonitrile-butadiene copolymer latices useful for component (A) are, for example, NBR latices obtained by copolymerizing 15 to 50% by weight, preferably 20 to 45% by weight of acrylonitrile with 85 to 50% by weight, preferably 80 to 55% by weight of butadiene, having glass transition temperatures between −60° C. and −10° C., preferably between −50° C. and −15° C. The NBR latices may be carboxy-modifed ones obtained by copolymerizing the above two monomers and not more than 8% by weight, preferably about 0.5 to 5% by weight of, for example, acrylic, methacrylic, itaconic, phthalic or maleic acid. The NBR latices may also be amide-modified ones obtained by copolymerizing the above two monomers and (meth) acrylic amide or the like.

Urethane resin emulsions that are used as component (A) are those ones obtained by dispersing urethane elastomers in water, having glass transition temperatures ranging from −60 to +10° C., preferably from −50 to 0° C.

Examples of natural rubber latices that can be used as component (A) include commercially available natural rubber latices, natural rubber latices graft-polymerized with styrene, methyl methacrylate, or the like, low-ammonia natural rubber latices, and low-protein or deprotenized natural rubber latices produced by repeatedly conducting dilution with water and centrifugal separation.

The above-described component (A), base rubber emulsion (latex), should be a high-solid-content emulsion (latex) having a solid content of preferably 45% by weight or more, more preferably 55% by weight or more, particularly 60 to 70% by weight. When component (A) having a solid content of less than 45% by weight is used, the resulting aqueous emulsion composition cannot have a high solid content. Such a composition cannot be rapidly dried, and thus decreases the productivity.

(B) Dispersing Agent

In the aqueous emulsion composition of the present invention, the dispersing agent, component (B), acts to uniformly disperse a filler, and to properly maintain the viscosity of the composition.

Examples of dispersing agents that can be used as component (B) include inorganic dispersing agents such as tripolyphosphates and pyrophosphates, and polymeric dispersing agents such as polycarboxylates and formalin-condensed naphthalenesulfonates. Of these, inorganic dispersing agents are preferred.

Component (B) is used in an amount of 0.3 to 2 parts by weight, preferably 0.5 to 1.5 parts by weight for 100 parts by weight (solid basis) of component (A). The use of less than 0.3 parts by weight of component (B) is not enough to uniformly disperse a filler. On the other hand, when component (B) is used in an amount of more than 2 parts by weight, the aqueous emulsion composition finally obtained cannot keep its viscosity; the composition thus undergoes separation, and a filler settles.

(C) Crosslinking Agent

In the aqueous emulsion composition of the present invention, the crosslinking agent, component (C), acts to cross-link component (A), thereby imparting increased strength, elasticity and improved aging resistance to a carpet.

Examples of crosslinking agents that can be used as component (C) include sulfur and zinc oxide.

Component (C) is used in an amount of 0.5 to 5 parts by weight, preferably 1 to 3 parts by weight for 100 parts by weight (solid basis) of component (A). The use of less than 0.5 parts by weight of component (C) is not enough to satisfactorily impart strength, elasticity and aging resistance to a carpet. On the other hand, when more than 5 parts by weight of component (C) is used, a carpet backed by using the resulting emulsion composition is stiff and non-elastic, and readily broken.

(D) Anti-foaming Agent

In the aqueous emulsion composition of the present invention, the anti-foaming agent, component (D), acts to prevent foaming that can occur during preparation of the emulsion composition, and foaming that can occur in the process of the backing of a carpet.

Examples of anti-foaming agents that can be used as component (D) include mineral oil nonionic surface-active agents; silicone antifoamers such as polydimethylsiloxane oils, and ethylene-oxide- or propylene-oxide-modified dimethyl silicones and emulsions thereof; mineral oils; and alcoholic antifoamers such as acetylene alcohol.

Component (D) is used in an amount of 0.1 to 4% by weight, preferably 0.3 to 3% by weight for 100 parts by weight (solid basis) of component (A). The use of less than 0.1 parts by weight of component (D) is not enough to fully obtain the anti-foaming effect. On the other hand, the use of more than 4 parts by weight of component (D) brings about cissing crawling, so that a carpet backed by using the resulting emulsion composition cannot have good appearance.

(E) Filler

Component (E) is one or more powdered fillers selected from the group consisting of calcium carbonate, aluminum hydroxide, silica sand, and barium sulfate.

The powdered filler is used as an extender for the purposes of increasing the solid content of the aqueous emulsion composition, and making a carpet weighty.

Component (E) is used in an amount of 100 to 600 parts by weight, preferably 150 to 500 parts by weight for 100 parts by weight (solid basis) of component (A). When component (E) is used in an amount of less than 100 parts by weight, it cannot fully serve as an extender, and cannot make a carpet weighty. On the other hand, when component (E) is used in an amount of more than 600 parts by weight, a carpet backed by using the resulting emulsion composition has an excessively heavy weight per unit area, and is poor in rubber elasticity.

The above-enumerated powdered fillers, component (E), can be used either singly or as a mixture of two or more members.

(F) Polyisocyanate Compound having Reactive Isocyanate Group (Curing Agent)

In the aqueous emulsion composition of the present invention, the polyisocyanate compound having reactive isocyanate group, component (F), serves as a curing agent. The polyisocyanate compound reacts with water according to, for instance, the following reaction scheme, thereby curing the emulsion composition:

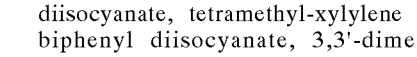

$$2RNCO+H_2O \rightarrow RNHCONHR+CO_2$$

wherein R represents an organic group. Water contained in the emulsion composition is thus consumed as the reaction proceeds, so that the emulsion composition applied to the back of a carpet is dried rapidly.

Examples of polyisocyanate compounds having reactive isocyanate group, component (F), for use in the present invention include diisocyanate compounds such as phenylene diisocyanate, tolylene diisocyanate, xylylene diisocyanate, tetramethyl-xylylene diisocyanate, 4,4'-biphenyl diisocyanate, 3,3'-dimethyl-4,4'-biphenyl diisocyanate, 4,4'-diphenylmethane diisocyanate, 3,3'-dimethyl-4,4'-diphenylmethane diisocyanate, triphenylmethane diisocyanate, naphthalene diisocyanate, isophorone diisocyanate, cyclohexylene diisocyanate, hydrogenated tolylene diisocyanate, hydrogenated xylylene diisocyanate, dicyclohexylmethane diisocyanate and hexamethylene diisocyanate; triisocyanate compounds such as biphenyl triisocyanate, diphenylmethane triisocyanate, triphenylmethane triisocyanate and naphthalene triisocyanate; and polymers thereof.

A polyisocyanate compound in the form of a prepolymer having at its terminal end reactive isocyanate group, obtainable by reaction between a polyisocyanate compound having reactive isocyanate group and a polyamine compound, a polyhydric alcohol, a polyol compound or the like can also be used as component (F) Examples of polyamine compounds that can be used for the above reaction include ethylenediamine, diethylenetriamine, triethylenetetramine, tetraethylenehexamine, pentaethylenehexamine, cyclohexylenediamines, isophoronediamines, phenylenediamines, tolylenediamines, xylylenediamines, diphenylmethanediamines, triphenylmethanepolyamines, piperazine, and aminoethyl piperazine.

Examples of polyhydric alcohols useful for the above-described reaction include ethylene glycol, propylene glycol, 1,4-butanediol, neopentyl glycol, hexamethylene glycol, diethylene glycol, triethylene glycol, glycerin, hexanetriol, trimethylolpropane, pentaerythritol, and sorbitol.

Examples of polyol compounds useful for the above-described reaction include polyether polyol compounds that can be obtained by addition polymerization reaction between the above-enumerated polyhydric alcohols and alkylene oxides such as ethylene oxide and propylene oxide; polyester polyol compounds that can be obtained by condensation reaction between the above polyhydric alcohols and polybasic acids such as maleic acid, succinic acid, adipic acid, sebacic acid, tartaric acid, terephthalic acid, and isophthalic acid; polyester polyol compounds obtainable by ring opening polymerization of lactones such as ε-caprolactone and γ-valerolactone; epoxypolyol compounds obtained by reacting epoxy resins having epoxy groups at both terminal ends with alkanolamines such as monoethanolamine and diethanolamine; homo- or co-polymers of hydroxyl group-containing polymerizable monomers such as 2-hydroxyethyl (meth)acrylate, 3-hydroxypropyl (meth)acrylate, 4-hydroxybutyl (meth) acrylate and trimethylolpropane (meth)acrylic monoesters; copolymers of the above-described hydroxyl group-containing polymerizable monomers and other copolymerizable monomers such as (meth)acrylic acid, methyl (meth) acrylate, ethyl (meth)acrylate, (meth)acrylonitrile, styrene and α-methylstyrene; and castor oil and its derivatives.

The above-enumerated polyisocyanate compounds, component (F), can be used either singly or as a mixture of two or more members.

Component (F) is used in an amount of 0.5 to 30 parts by weight, preferably 2 to 20 parts by weight for 100 parts by weight (solid basis) of component (A). When less than 0.5 parts by weight of component (F) is used, the aqueous emulsion composition finally obtained cures slowly. On the other hand, when more than 30 parts by weight of component (F) is used, the resulting aqueous emulsion composition cures too quickly; such a composition is poor in workability because it cures even before application.

To obtain the aqueous emulsion composition of the invention, component (F) can be added to the high-solid-content emulsion compound prepared by mixing the above-described components (A) to (E), at any point of time between the completion of preparation of the emulsion compound and the application of the aqueous emulsion composition. It is however desirable to make the aqueous emulsion composition just before application, by adding component (F) to the high-solid-content emulsion compound, and stirring the mixture.

Other Additives (Antioxidants, etc.)

In addition to the above-described components (A) to (F), pigments such as carbon black, red oxide and organic colorants, antioxidants, surface-active agents, thickeners, preservatives, and the like may optionally be incorporated into the aqueous emulsion composition of the present invention.

Preparation of Aqueous Emulsion Composition of the Invention

The aqueous emulsion composition for use in the method of the present invention is obtained, before application, by adding the above-described polyisocyanate compound, component (F), to the high-solid-content emulsion compound having a solid content of 75% by weight or more, prepared by mixing the above-described components (A) to (E).

The high-solid-content emulsion compound is herein required to have a solid content of as high as 75% by weight or more, preferably 80 to 87% by weight. When an emulsion compound having a solid content of less than 75% by weight is used, the resulting aqueous emulsion composition has a high water content. It is therefore necessary to use an increased amount of the polyisocyanate compound, component (F), to cure the aqueous emulsion composition, and the production cost is thus increased. In addition, since such a composition readily foams, it is poor in both performance and drying characteristics.

The mixing of components (A) to (E), and that of the high-solid-content emulsion compound containing components (A) to (E) and the polyisocyanate compound, component (F), can be conducted with a mixer such as a line blender, a kneader, or a blender. In either case, the mixing temperature is generally from 5 to 35° C.

Method of Backing Carpets

According to the method of the present invention, the aqueous emulsion composition of the invention obtained by adding component (F), which serves as a curing agent, to the high-solid-content emulsion compound containing the above-described components (A) to (E) is applied to the back of a carpet; a fabric is laminated to the composition-applied surface of the carpet; and the emulsion composition applied is thermally cured and then dried. With this method, the time required for the drying step is drastically shortened, and a carpet to which a fabric is laminated through a strong cured film is successfully obtained.

Typical examples of carpets that can be obtained by the method of the invention are tile carpets which have fiber-made working surfaces, which are square in shape, which are backed by strong reinforcing layers and which are set on floors by being joined together.

Examples of fibers useful for producing such tile carpets include polyester fibers, acrylic fibers, polyamide fibers, wool, and polypropylene fibers. The tile carpets generally have thicknesses of approximately 5 to 10 mm, preferably about 6 to 9 mm, and masses of pile per unit of approximately 2,000 to 6,000 g/m$^2$, preferably about 3,000 to 5,000 g/m$^2$.

Besides the tile carpets, heavy-weight carpets such as contract carpets for use in hotels, department stores, etc., residential carpets for use in apartment houses, individual homes, etc., and center rugs are also included in the carpets obtainable by the method of the present invention.

Examples of fibers useful for producing raw fabrics for the above-mentioned heavy-weight carpets include polyester fibers, acrylic fibers, polyamide fibers, wool, and polypropylene fibers. Such raw fabrics generally have thicknesses of approximately 3 to 13 mm, preferably about 5 to 10 mm, and masses of pile per unit of approximately 600 to 2,000 g/m$^2$, preferably about 800 to 1,500 g/m$^2$.

On the other hand, fabrics to be laminated to the back of carpets are, for example, non-woven fabrics, knitted webs (meshes), and woven fabrics. Of these, non-woven fabrics are preferred.

Examples of materials for these fabrics include polyolefins such as polyethylene and polypropylene, polyesters such as polyethylene terephthalate and polybutylene terephthalate, polyamides such as nylon 6 and nylon 6,6, regenerated fibers such as rayon, semi-synthetic fibers such as cellulose acetate, natural fibers such as cotton and wool, and inorganic fibers such as glass fibers and carbon fibers.

The above-described non-woven fabrics are generally produced by such a method as spun bonding, a papermaking process, or needle punching.

In the present invention, the basis weights of non-woven fabrics to be laminated to tile carpets are generally about 20 to 200 g/m$^2$, preferably about 50 to 150 g/m$^2$, and those of non-woven fabrics to be laminated to raw fabrics for heavy-weight carpets are generally about 150 to 1,500 g/m$^2$, preferably about 300 to 1,000 g/m$^2$.

In the method of backing carpets according to the present invention, the polyisocyanate compound (F), which serves as a curing agent, is added to the high-solid-content emulsion compound containing, as main components, components (A) to (E) to obtain the aqueous emulsion composition of the invention. Since the polyisocyanate compound reacts with water, water contained in the emulsion compound is consumed as the reaction proceeds. Therefore, heating at 160° C. for approximately 3 minutes, for example, is enough to obtain a cured and dried film (a laminating layer) having high strength, capable of withstanding practical use. The time required for the drying step can thus be drastically shortened.

The following is one example of the method of backing carpets according to the present invention. However, the present invention is not limited to the following example in any way.

Just before application, the above-described polyisocyanate compound, component (F), is added to a high-solid-content emulsion compound prepared by mixing the above-described components (A) to (E), having a solid content of 75% by weight or more, and the mixture is stirred by using a mixer such as a line blender to obtain an aqueous emulsion composition of the invention. The aqueous emulsion composition obtained is applied to the back of a tile carpet at a thickness of 1 to 3 mm, or to the back of a raw fabric for a heavy-weight carpet at a thickness of 0.5 to 1 mm. A fabric such as a non-woven fabric is then laminated to the composition-applied surface of the tile carpet or raw fabric. This laminate is passed through a hot-air dryer at a temperature between 100° C. and 180° C., preferably between 150° C. and 170° C. over a period of time of 1 to 20 minutes, preferably 3 to 15 minutes to thermally cure and then dry the emulsion composition applied, thereby obtaining a carpet backed by the fabric.

The advantages of the method of backing carpets according to the present invention over the conventional methods are as follows.

(1) When conventional tile carpets backed by fabrics through the use of sols prepared by mixing vinyl chloride resins and plasticizers are incinerated as wastes after use, they emit dioxin and chlorine gas. On the contrary, tile carpets backed by the method of the present invention, using the aqueous emulsion compositions emit neither chlorine gas nor dioxin when incinerated because the emulsion compositions contain no chlorine.

(2) One of the conventional methods of backing heavy-weight carpets is as follows: compositions prepared by mixing aqueous emulsions with thermoplastic resin powders such as polyethylene powder are applied to the back of raw fabrics for heavy-weight carpets; fabrics such as non-woven fabrics are laminated to the composition-applied surfaces of the raw fabrics; and the compositions applied are then dried. In such a method, the compositions applied cannot be dried in a short time, so that the production rate cannot be increased. In addition, there is a limitation on the thickness of the fabrics such as non-woven fabrics to be laminated. On the other hand, the method of the present invention can attain increased productivity regardless of the thickness of the fabrics such as non-woven fabrics to be laminated. Backed carpets can thus be inexpensively obtained by the method of the invention.

(3) In the conventional method in which fabrics such as non-woven fabrics are laminated to the back of carpets after applying thereto melted thermoplastic resins extruded from extruders, or after sprinkling thereon powders, and melting them by heating, or after placing thereon thermoplastic resin sheets, and melting them by heating, there is a limitation on the width of carpets to be backed. It is therefore impossible to produce wide carpets, and the carpets backed by these methods are costly. Further, powders tend to scatter to make the working environment worse. According to the method of the present invention, carpets or raw fabrics having any width can be backed, and improved productivity can be attained regardless of the thickness of fabrics to be laminated for backing. Backed carpets can thus be inexpensively produced by the method of the invention. In addition, the aqueous emulsion compositions of the invention are safe and easy to handle, and can readily be applied.

According to the present invention, the aqueous emulsion composition obtained by adding the polyisocyanate compound, which serves as a curing agent, to the high-solid-content emulsion compound is applied to the back of a carpet. Therefore, the time needed for thermally curing and drying the emulsion composition applied becomes much shorter than the time required for drying emulsions that are used in the conventional methods. The time required for the drying step can thus be drastically shortened.

Further, a carpet backed by the method of the present invention scarcely fumes, and it emits only small amounts of toxic gases when burned, as compared with a carpet backed by the conventional method using vinyl chloride resin sols. Backed carpets obtained by the method of the invention are thus very favorable from the viewpoint of environmental pollution.

Furthermore, the aqueous emulsion compositions of the present invention are safe, easy to handle and excellent in application properties as compared with emulsions for use in the conventional methods.

EXAMPLES

The present invention will now be explained more specifically by referring to the following examples. However, these examples are not intended to limit or restrict the scope of the present invention in any way. In the examples, all "part(s)" and "%" are based on weight, unless otherwise specified.

Referential Example 1, Comparative Referential Examples 1 to 4

(1) Formulations of Compounds

Compounds A to E were prepared in accordance with the formulations shown in Table 1, and used in Examples 1 and 2, and Comparative Examples 1 to 4.

TABLE 1

| | Ref. Ex.1 | Comp. Ex.1 | Comp. Ex.2 | Comp. Ex.3 | Comp. Ex.4 |
|---|---|---|---|---|---|
| Compounds' name | A | B | C | D | E |
| JSR 0545 (solid basis) | 100 | 100 | — | 100 | — |
| JSR AE555(solid basis) | — | — | — | — | 100 |
| Vinyl chloride resin | — | — | 100 | — | — |
| Polyethylene powder | — | — | — | — | 50 |
| DOP | — | — | 100 | — | — |
| AC141 | — | — | 3 | — | — |
| Na tripolyphosphate | 0.5 | 0.5 | — | 0.5 | 0.5 |
| Zinc oxide | 1.0 | 1.0 | — | 1.0 | — |
| NOPCO DF-122 | 0.5 | 0.5 | — | 0.5 | 0.5 |
| Calcium carbonate | 450 | 450 | 400 | 400 | — |
| Black pigment | 0.3 | 0.3 | 0.5 | — | — |

(2) Ingredients

JSR 0545: Carboxy-modified SBR latex manufactured by JSR Corporation, Japan, having a solid content of 55%.

JSR AE555: Acryl-styrene copolymer emulsion manufactured by JSR Corporation, Japan, having a solid content of 49%.

DOP: Dioctyl phthalate, plasticizer.

AC 141: Stabilizer for vinyl chloride resins, manufactured by ASAHI DENKA KOGYO K.K., Japan.

NOPCO DF-122: Mineral oil antifoamer manufactured by SAN NOPCO LIMITED, Japan.

The ingredients shown in the above table, placed in a 3-litter vessel were mixed by agitation at approximately 600 rpm for about 20 minutes, using an agitator Type LR500B manufactured by Yamato Scientific Co., Ltd., Japan, equipped with a cross-shaped agitating blade having a length of 80 mm to obtain each one of compounds A to E in an amount of approximately 3 kg.

The solid contents and viscosities of these compounds, shown in Table 2 were measured values obtained in accordance with JIS K6883.

Example 1, Comparative Examples 1 and 2

(3) Burning Test

Just before application, an aqueous emulsion composition of the present invention was prepared by adding CORONATE 3053 (tolylenediisocyanate manufactured by NIPPON POLYURETHANE INDUSTRY CO., LTD., Japan) to the above-prepared compound A, high-solid-content emulsion compound, in an amount of 12.0 parts by weight for 100 parts by weight (solid basis) of the latex used. Each one of this emulsion composition and the above-obtained compounds B and C was applied, by utilizing a guide roll, to the back of a tile carpet (made of nylon 6; thickness 3.9 mm; mass of pile per unit 680 g/m$^2$) at a thickness of 3 mm, and a non-woven fabric (made of polyethylene terephthalate; basis weight 80 g/m$^2$) was then laminated to the composition- or compound-applied surface of the carpet. The laminates respectively obtained in this manner were placed in a dryer at 160° C. for 8 minutes to cure and dry the composition or compounds to obtain test sheets. These test sheets were subjected to burning tests. The results are shown in Table 2.

The content of combustibles in each test sheet, the calorific value of each test sheet, and the amounts of gases (CO, chlorine gas) emitted by each test sheet upon burning were measured in the following manners.

Content of combustibles: Calculated from the amount of combustibles incorporated into the compound.

Calorific value: Measured in accordance with JIS K2279.

Amounts of gases emitted: The amount of CO gas emitted was measured in accordance with JIS K0098, and that of $Cl_2$ gas emitted, in accordance with JIS K0107.

(4) Backing of Carpets

Just before application, an aqueous emulsion composition of the invention was prepared by adding CORONATE 3053 to the above-obtained compound A, high-solid-content emulsion compound, in an amount of 12.0 parts by weight for 100 parts by weight (solid basis) of the latex used. Each one of this emulsion composition and the above-obtained compounds B and C was applied, by using a guide roll, to the back of the same tile carpet as in the above burning test at a thickness of 2 mm, and a sheet of glassine paper (basis weight 35 g/m$^2$) was then laminated to the composition- or compound-applied surface of the carpet. Each one of the above emulsion composition and compounds was further applied, by using a guide roll, to the surface of the glassine paper to a thickness of 2 mm, and a non-woven fabric (made of polyethylene terephthalate; basis weight 80 g/m$^2$) was laminated to the composition- or compound-applied surface. The laminates respectively obtained in this manner were placed in a dryer at 160° C. for 8 minutes to cure and dry the composition or compounds to obtain backed carpets. These backed carpets were subjected to performance tests. The results are shown in Table 2.

In the performance tests, the influences of heat and water (curling, change in dimensions) on the backed carpets, and the tuft withdrawal forces of the carpets were determined in the following manners.

Curling: Curling caused by heat and water was determined in accordance with JIS L4406.

Percentage dimensional change: Change in dimensions due to heat and water was determined in accordance with JIS L4406.

Tuft withdrawal force: Measured in accordance with JIS L 4406.

TABLE 2

| | Example 1 | Comp. Ex. 1 | Comp. Ex. 2 |
|---|---|---|---|
| Compound | A | B | C |
| Solid content (%) | 85.4 | 85.2 | 100 |
| Viscosity (mPa · s) | 28,000 | 25,000 | 26,000 |
| Content of combustibles (%) | 19.6 | 18.2 | 33.7 |
| Time needed for curing and drying (at 160°) | after 3 min. OK | after 9 min. NG | after 3 min. OK |
| Burning Tests: | | | |
| Calorific value (cal/g) | 1,970 | — | 3,120 |
| Amounts of gases emitted; | | | |
| CO (ppm) | 85 | — | 268 |
| $Cl_2$ (ppm) | 0 | — | 55 |
| Performance Tests: | | | |
| Curling (mm) | 0.8 | — | 0.5 |
| Percentage dimensional change; | | | |
| Lengthwise (%) | 0.08 | — | 0.06 |
| Crosswise (%) | 0.08 | — | 0.06 |
| Tuft withdrawal force (N/1 tuft) | 40 | — | 48 |

The result of Example 1 shows as follows: a polyisocyanate compound, CORONATE 3053, is added to a high-solid-content emulsion (latex) compound having a solid content of as high as 85% to obtain an aqueous emulsion composition of the invention; and the emulsion composition was applied to the back of a carpet, and then thermally cured and dried. The data in terms of Example 1 shown in Table 2 clearly demonstrate that the time needed for curing and drying the emulsion composition applied is short, that the backed carpet emits only small amounts of noxious gases, especially no chlorine gas, when burned, and that the backed carpet is also excellent in performance. On the other hand, a polyisocyanate compound, curing agent, was not used in Comparative Example 1, so that the laminate obtained did not show sufficiently high strength even after it was heated at 160° C. for 9minutes; it was therefore impossible to test this laminate. Comparative Example 2 is as follows: a vinyl chloride resin sol, which is usually used for backing carpets, was applied to the back of a tile carpet, and then dried by heating. As shown in Table 2, the calorific value of the backed carpet of Comparative Example 2, and the amounts of gases (CO, chlorine gas) emitted by this carpet upon burning are much greater than those in the case of the backed carpet of Example 1.

Example 2, Comparative Examples 3 and 4

(5) Peel Test

Just before application, an aqueous emulsion composition of the invention was prepared by adding CORONATE 3053 to the above-obtained compound A, high-solid-content emulsion compound, in an amount of 12.0 parts by weight for 100 parts by weight (solid basis) of the latex used. Each one of this emulsion composition and the above-obtained compounds D and E was applied, by using a guide roll, to the back of a raw fabric (made of nylon 6; thickness 10 mm; mass of pile per unit 1,200 g/m$^2$) for a carpet at a thickness of 0.8 mm, and a non-woven fabric (made of polyethylene terephthalate; basis weight 700 g/m$^2$) was then laminated to the composition- or compound-applied surface of the raw fabric. The laminates respectively obtained in this manner were placed in a dryer at 160° C. for 8 minutes to cure and dry the composition or compounds to obtain test sheets. The peeling strengths of these test sheets were measured in accordance with JIS L1023. The results are shown in Table 3.

(6) Tuft Withdrawal Test

Just before application, an aqueous emulsion composition of the invention was prepared by adding CORONATE 3053 to the above-obtained compound A, high-solid-content emulsion compound, in an amount of 12.0 parts by weight for 100 parts by weight (solid basis) of the latex used. Each one of this emulsion composition and the above-obtained compounds D and E was applied, by using a guide roll, to the back of the same raw fabric as in the above peel test so that the composition or compound applied would be a 0.8 mm thick film when dried, and a non-woven fabric (made of polyethylene terephthalate; basis weight 700 g/m$^2$) was then laminated to the composition- or compound-applied surface of the raw fabric. The laminates respectively obtained in this manner were placed in a dryer at 160° C. for 8 minutes to cure and dry the composition or compounds to obtain test sheets. These test sheets were subjected to tuft withdrawal tests. The results are shown in Table 3.

TABLE 3

| | Example 2 | Comp. Ex. 3 | Comp. Ex. 4 |
|---|---|---|---|
| Compound | A | D | E |
| Solid content (%) | 85.4 | 75.2 | 54.0 |
| Viscosity (mPa · s) | 28,000 | 30,000 | 23,000 |
| Time needed for curing and drying (at 160°) | after 3 min. OK | after 9 min. NG after 15 min. OK | after 9 min. NG after 15 min. OK |
| Peeling strength: | | | |
| Lengthwise (N/5 cm) | 81 | 32 | 53 |
| Crosswise (N/5 cm) | 67 | 30 | 48 |
| Tuft withdrawal force (N/1 tuft) | 40 | 35 | 50 |

The date shown in Table 3 demonstrate that the time needed for curing and drying the emulsion composition used in Example 2 is short and that the heavy-weight carpet obtained in Example 2 is also excellent in performance. On the other hand, a polyisocyanate compound, curing agent, was not used in Comparative Example 3, so that the laminate obtained did not show sufficiently high strength even after it was dried by heating at 160° C. for 9 minutes; it was thus impossible to test this laminate. However, it was possible to test the laminate after it was subjected to drying at the temperature for 15 minutes. Comparative Example 4 is as follows: a compound prepared by mixing an aqueous emulsion and polyethylene powder, currently used for backing carpets was applied to the back of a raw fabric for a carpet, and then dried by heating. A polyisocyanate compound, curing agent, was not used also in this example, so that the laminate obtained did not show sufficiently high strength even after it was dried by heating at 160° C. for 9minutes; it was therefore impossible to test this laminate. However, it was possible to test the laminate after it was subjected to drying at the temperature for 15 minutes.

What is claimed is:

1. An aqueous emulsion composition comprising:

a high-solid-content emulsion compound which comprises:

(A) 100 parts by weight (solid basis) of at least one latex selected from the group consisting of styrene-butadiene copolymer latices, acrylonitrile-butadiene copolymer latices, and natural rubber latices, (B) 0.3 to 2 parts by weight of a dispersing agent, (C) 0.5 to 5 parts by weight of a crosslinking agent, wherein said crosslinking agent comprises sulfur or zinc oxide or both, (D) 0.1 to 4 parts by weight of an anti-foaming agent, and (E) 100 to 600 parts by weight of at least one powdered filler selected from the group consisting of calcium carbonate, aluminum hydroxide, silica sand, and barium sulfate; and 0.5 to 30 parts by weight of a polyisocyanate compound having reactive isocyanate group, wherein the polyisocyanate compound is added to the high-solid-content emulsion compound.

2. A method of backing a carpet, comprising the steps of applying said aqueous emulsion composition according to claim 1 to the back of a carpet, and thermally curing and then drying the emulsion composition applied.

3. A method of backing a carpet, comprising the steps of applying said aqueous emulsion composition according to claim 1 to the back of a carpet, laminating a fabric to the composition-applied surface of the carpet, and thermally curing and then drying the emulsion composition applied.

4. A carpet backed by the method according to claim 2.

5. A carpet backed by the method according to claim 3.

6. The aqueous emulsion composition according to claim 1, wherein said component (A) is a styrene-butadiene copolymer latex.

7. The aqueous emulsion composition according to claim 1, wherein said component (A) is an acrylonitrile-butadiene copolymer latex.

8. The aqueous emulsion composition according to claim 1, wherein said component (A) is a natural rubber latex.

9. The aqueous emulsion according to claim 1, wherein said dispersing agent is an inorganic dispersing agent comprising triopolyphosphates or pyrophosphates or both.

10. The aqueous emulsion according to claim 1, wherein said dispersing agent is a polymeric dispersing agent comprising polycarboxylates or formalin-condensed naphthalenesulfonates or both.

11. The aqueous emulsion according to claim 1, wherein said anti-foaming agent comprises mineral oil non-ionic surfactants, polydimethylsiloxane oils, ethylene-oxide-or propylene-oxide modified dimethyl silicones or emulsions thereof, mineral oils or acetylene alcohols.

12. The aqueous emulsion according to claim 1, wherein the polyisocyanate compound is a diisocyanate.

13. The aqueous emulsion according to claim 1, wherein the polyisocyanate compound is a triisocyanate.

14. An aqueous emulsion composition obtained by a process comprising:

mixing a high-solid-content emulsion compound which comprises:

(A) 100 parts by weight (solid basis) of at least one latex selected from the group consisting of styrene-butadiene copolymer latices, acrylonitrile-butadiene copolymer latices, and natural rubber latices, (B) 0.3 to 2 parts by weight of a dispersing agent, (C) 0.5 to 5 parts by weight of a crosslinking agent, wherein said crosslinking agent comprises sulfur or zinc oxide or both, (D) 0.1 to 4 parts by weight of an anti-foaming agent, and (E) 100 to 600 parts by weight of at least one powdered filler selected from the group consisting of calcium carbonate, aluminum hydroxide, silica sand, and barium sulfate; and adding 0.5 to 30 parts by weight of a polyisocyanate compound having reactive isocyanate group to the high-solid-content emulsion compound.

15. The aqueous emulsion according to claim 14, wherein said dispersing agent is an inorganic dispersing agent comprising triopolyphosphates or pyrophosphates or both.

16. The aqueous emulsion according to claim 14, wherein said dispersing agent is a polymeric dispersing agent comprising polycarboxylates or formalin-condensed naphthalenesulfonates or both.

17. The aqueous emulsion according to claim 14, wherein said anti-foaming agent comprises mineral oil non-ionic surfactants, polydimethylsiloxane oils, ethylene-oxide-or propylene-oxide modified dimethyl silicones or emulsions thereof, mineral oils or acetylene alcohols.

18. The aqueous emulsion according to claim 14, wherein the polyisocyanate compound is a diisocyanate.

19. The aqueous emulsion according to claim 14, wherein the polyisocyanate compound is a triisocyanate.

20. A method comprising:

mixing a high-solid-content emulsion compound which comprises:

(A) 100 parts by weight (solid basis) of at least one latex selected from the group consisting of styrene-butadiene copolymer latices, acrylonitrile-butadiene copolymer latices, and natural rubber latices, (B) 0.3 to 2 parts by weight of a dispersing agent, (C) 0.5 to 5 parts by weight of a crosslinking agent, wherein said crosslinking agent comprises sulfur or zinc oxide or both, (D) 0.1 to 4 parts by weight of an anti-foaming agent, and (E) 100 to 600 parts by weight of at least one powdered filler selected from the group consisting of calcium carbonate, aluminum hydroxide, silica sand, and barium sulfate; and adding 0.5 to 30 parts by weight of a polyisocyanate compound having reactive isocyanate group to the high-solid-content emulsion compound.

21. The method according to claim 20, wherein said dispersing agent is an inorganic dispersing agent comprising triopolyphosphates or pyrophosphates or both.

22. The method according to claim 20, wherein said dispersing agent is a polymeric dispersing agent comprising polycarboxylates or formalin-condensed naphthalenesulfonates or both.

23. The method according to claim 20, wherein said anti-foaming agent comprises mineral oil non-ionic surfactants, polydimethylsiloxane oils, ethylene-oxide-or propylene-oxide modified dimethyl silicones or emulsions thereof, mineral oils or acetylene alcohols.

24. The method according to claim 20, wherein the polyisocyanate compound is a diisocyanate.

25. The method according to claim 20, wherein the polyisocyanate compound is a triisocyanate.

* * * * *